United States Patent [19]

Tiner

[11] 4,193,243

[45] Mar. 18, 1980

[54] PANEL REPAIR KIT

[76] Inventor: Francis L. Tiner, 3508 Coronado Dr., Sarasota, Fla. 33581

[21] Appl. No.: 883,144

[22] Filed: Mar. 3, 1978

[51] Int. Cl.[2] ..... E04G 23/02; B32B 35/00

[52] U.S. Cl. ..... 52/514; 81/3 R; 29/278; 156/98

[58] Field of Search ..... 52/514; 248/220.4; 81/3 R; 29/278; 156/98

[56] References Cited

U.S. PATENT DOCUMENTS

| | | | |
|---|---|---|---|
| 3,524,616 | 8/1970 | Marschak | 248/220.4 |
| 3,532,318 | 10/1970 | Lloyd | 248/220.4 |
| 3,690,084 | 9/1972 | Leblanc | 52/514 |
| 3,874,505 | 4/1975 | Mirarchi | 52/514 |
| 4,075,809 | 2/1978 | Sirkin | 52/514 |

*Primary Examiner*—Reinaldo P. Machado
*Attorney, Agent, or Firm*—Fleit & Jacobson

[57] ABSTRACT

A kit for repairing a hole or providing a more substantial mounting for an anchor device, as in a panel of a hollow construction, such as room partition or a hollow door, includes a thin sheet of perforated material which is cut to form a plate slightly exceeding the size of the hole after it has been squared-up. A suitable adhesive, such as two sided adhesive tape, is applied to a face of the perforate plate along substantially the entire periphery of the plate. An operatively rigid tool having resilient legs with feet at adjacent ends, has its legs slight spread apart and the feet inserted through spaced apart ones of the perforations until the legs seat in these perforations and the tool is generally perpendicular to the plate. A rod is then inserted through a perforation preferably aligned with and equally spaced from the perforations receiving the legs. An outer end of the tool has a recess which receives the rod, so that the tool and rod may be held by the fingers of one hand for inserting the plate through the hole and then pulling outwardly on the tool so that the adhesive secures the plate to the inner face of the panel being repaired. The rod is then pushed through the perforation until it is seated against a fixed portion of the hollow construction, such as another panel, for example. The rod may be smooth, in which event friction between the rod and the plate operatively fixes the rod and plate to each other; or the rod may have abutments for engaging the panel about the perforation, to operatively fixedly secure it to the rod. The outer portion of the rod is then broken off proximate the plate, and the hole is filled with a suitable patching material.

19 Claims, 6 Drawing Figures

PANEL REPAIR KIT

This invention relates to a repair kit and, more particularly, to a kit for repairing a hole in a panel of a hollow construction, and to an installation tool forming part of the kit. Disclosure Document 065227, filed Oct. 25, 1977, has been incorporated into the Patent and Trademark Office file of this application, and is hereby incorporated by reference in this application.

BACKGROUND OF THE INVENTION

It is often a difficult task to repair a hole in wallboard or a panel of a hollow door. If the hole is relatively small, up to about three inches, for example, newsprint or other paper may be stuffed through the hole in an attempt to provide a backing for holding the patching material in place until it sets. Larger holes generally require some sort of carpentry in order to provide a backing for the patching material. Other expedients are shown in various U.S. Patents, for providing a backing for the patching material. In general, these patented expedients are far too costly to be readilly accepted by the public at large, and some of them are generally inadequate.

For example, in U.S. Pat. No. 3,834,107, a screen facing plate is held in position by a screw assembly which is clamped against a panel spaced from the panel being repaired. U.S. Pat. No. 3,690,084, shows a plurality of embodiments securing a hinged perforated plate in place by means of a spring pressed plunge or a rachet assembly seated against an opposed panel of a hollow construction. U.S. Pat. No. 3,583,122, utilizes a hinged plate, and a bolt and nut for securing the hinged plate in place. In U.S. Pat. No. 2,997,416, a plate must be cut to fit within the hole to be repaired, and is held in place by a bar extending across the inner face of the panel being repaired, with a bolt extending through the bar and threaded into a nut operatively secured to the bar, and a frame holds the assembly in place. U.S. Pat. No. 2,638,774, shows quite an elaborate unit including a perforate plate held in place by a threaded assembly including a swivel, and would be expensive. A relatively simple and inexpensive unit is shown in U.S. Pat. No. 3,874,505, but is simply adhesively held in place without the benefit of being clamped against an opposed panel or other fixed member.

BRIEF STATEMENT OF THE INVENTION

The invention, in brief, is directed to a kit for repairing a hole in a panel of a hollow construction, and/or providing reinforcement for a suitable anchor. The kit includes a preferably flexible, thin, perforate plate which is cut to a size just slightly larger than the hole to be patched. The hole is preferably squared-up and then the plate is cut to size. Adhesive, preferably a two sided tape, is applied to a face of the plate along its periphery for engaging the inner face of the panel to be repaired. A tool which is operatively effectively rigid, has opposed resilient legs with feet which are passed through spaced apart perforations until the legs are seated in the perforations and the tool is generally normal to the plate. A rigid rod is passed through a perforation between the perforations receiving the legs, and is freely seated in a recessed portion of an outer end of the tool. The assembly is then passed into the hole by gripping the tool and rod between the fingers of one hand, the plate is aligned with the hole, and the tool is pulled outwardly to adhesively secure the plate to the inner face of the panel. Next the rod is pushed inwardly until it seats against a fixed member of the hollow construction, such as another panel, for example. The outer end of the rod is then broken off and the hole is filled with a suitable patching material which is held in place during setting by the perforate plate. The previously described tool is a sub-combination of the invention.

It is an object of this invention to provide a new and useful kit for use in patching a hole in a panel of a hollow construction.

A more specific object is provision of a new and useful kit for patching a hole in a panel of a hollow construction having a substantially fixed part spaced inwardly from and opposed to an inner face of the panel, the kit including, when operatively assembled, a perforate plate for insertion through the hole and for abutting engagement with the inner face of the panel, a rod received in one of the perforations and having an end portion for seated engagement with the fixed part of the hollow construction, with provision for maintaining the plate operatively fixed to the panel and including the rod and plate being in operatively fixed relationship with each other, and the plate being adhesively secured to the inner face of the panel. Related objects include: the plate and rod being operatively fixed to each other by tight frictional engagement between each other or by cooperating abutments thereon; the adhesive being resilient and of sufficient thickness to conform to irregularities along the inner face of the panel, and preferably being a two sided adhesive tape; and a tool having feet releasably interlocked with perforations in the plate, and having a recess in its outer end for receiving the rod.

A further object of the invention is provision of a new and useful tool having resilient, opposed legs with free ends having feet, and opposite ends of the legs being joined by a recessed portion. Related objects include the feet being substantially parallel to each other and extending in the same general direction from and substantially normal to the legs; the recessed portion defining substantially equal included angles with the legs.

These and other objects and advantages of the invention will become apparent from the following description and the accompanying drawing, in which:

DESCRIPTION OF THE ILLUSTRATED EMBODIMENTS

Figures 1, 2, 3, 4, 5, 6:
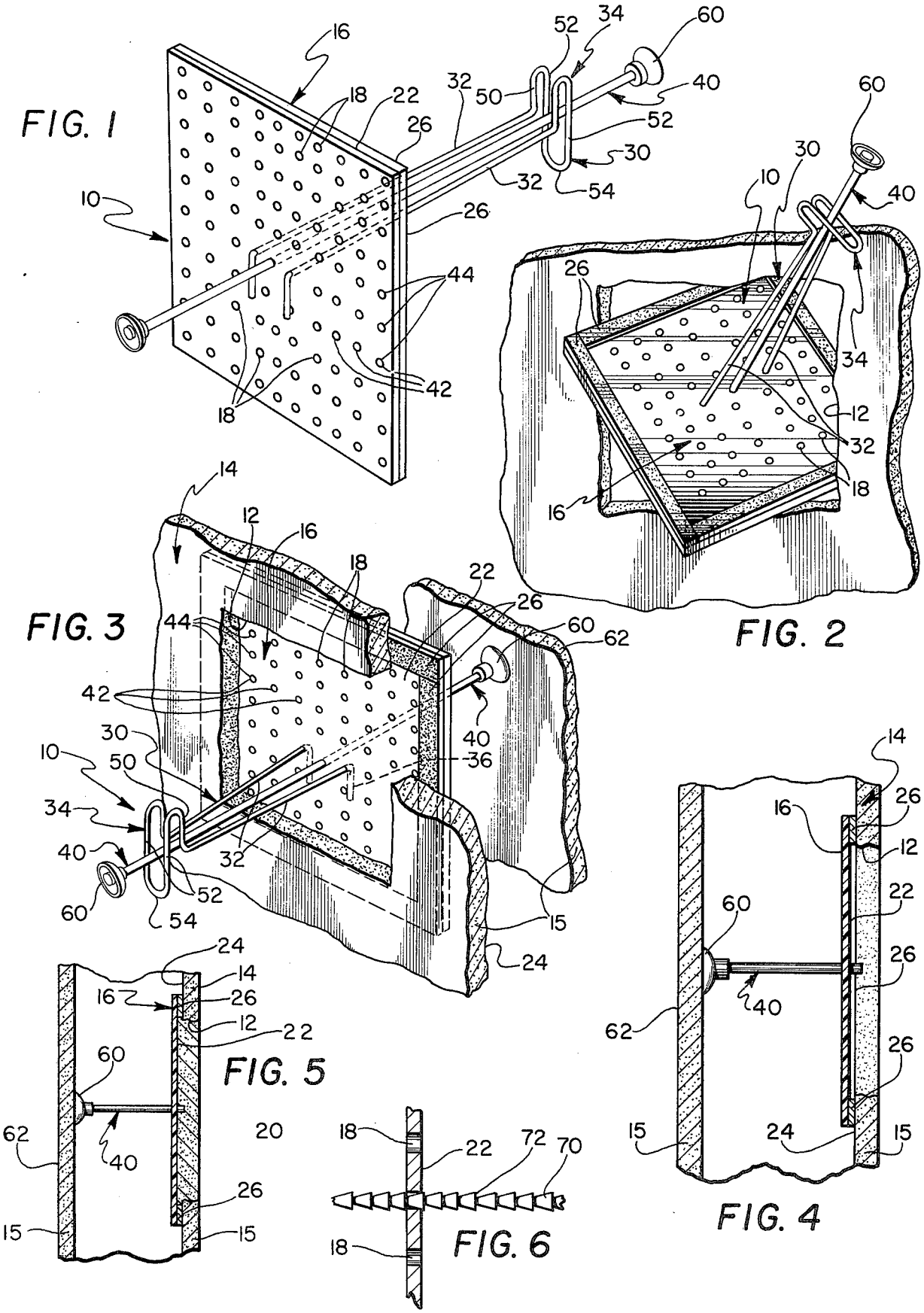
FIG. 1 is a perspective rear view of the assembled kit, including a perforate plate with two sided adhesive tape along the periphery of the front face of the plate, a rod extending through the plate, and an installation tool mounted on the plate.
FIG. 2 is a perspective view of the assembled kit as it is inserted through a hole in a panel of a hollow construction.
FIG. 3 is a fragmentary, perspective front view of the kit after it is operatively positioned through the hole and the rod seated against a fixed portion of the hollow construction.
FIG. 4 is an elevational sectional view of the hollow construction after the front portion of the rod has been severed.
FIG. 5 is an elevational sectional view similar to FIG. 4, but after the hole has been patched.
FIG. 6 is an elevational sectional view to a larger scale, illustrating another embodiment of a rod.

Before proceeding with a detailed description of the illustrated embodiments of the invention it should be understood that various materials other than those shown and described may be utilized in practicing the invention. Additionally, the perforate plate to be described is preferably cut from a large sheet, but plates of various sizes may be provided in the kit, rather than one large plate.

Referring to the drawings, a kit 10 is illustrated for providing a backing when repairing a hole 12 in a panel 14 of a hollow construction 15 (FIGS. 3, 4 and 5) such as a dry wall partition or door, for example.

The kit 10, in its presently preferred form, includes a plate 16 have perforations 18 for receiving a moldable patching material 20 (FIG. 5) such as plaster of paris, to aid in retaining the patching material in place. The kit may also be used to provide a sturdy base for any sort of anchor, the plate 16 spreading the anchored load over a greater area of the panel. A face 22 of the plate 16 which is adjacent the inner face 24 of the panel 14 is provided with an adhesive along its periphery for adhering the plate to the panel inner face, and as herein illustrated the adhesive is in the form of a two sided adhesive tape 26 having a sufficiently thick resilient body preferably of at least one-sixteeth-inch thick for conforming to irregularities along the panel inner face 24, or a suitable caulking material or adhesive used in installing thin sheet paneling may be used, if desired.

A tool 30 for aiding in installing the plate 16 is preferably formed of a single length of slightly resilient steel wire slightly smaller in diameter than the diameter of the perforations 18. The tool 30 has a pair of opposed legs 32 which diverge from their outer ends where they are joined together by a recessed portion 34, to their adjacent inner ends having feet 36 generally parallel to each other and normal to the associated leg. In assembling the kit 10 the legs 32 are spaced apart and the feet 36 are slipped through spaced ones of the perforations 18 with the free ends of the legs 32 seated in the perforations 18. The recessed portion 34 of the tool serves to receive an effectively rigid rod 40 which, in a normal installation for repairing a relatively small hole 12 in the panel 10, is preferably seated in a perforation 18 equally spaced from the perforations which receive the tool legs 32. The perforations are formed in equally spaced horizontal rows 42 and vertical rows 44, and the rod 40 and legs 32 are preferably received in perforations 32 in the same horizontal row 42. When installing a larger plate 16, a plurality of rods 40 may be appropriately spaced across the plate.

The recessed portion 34 of the tool 30 is illustrated as formed by portions 50 of the wire bent upwardly from the outer ends of the legs 32 and then bent to form downwardly extending return portions 52 which are spaced apart and joined at their lower ends by a U-shaped portion 54. The rod 40 is normally received between the return portions 52, and is retained in the position illustrated in the drawings by the fingers of one hand which also grip the tool 30.

More particularly, the plate 16 may be polyethlene about one-sixteenth inch thick with the perforations about three thirty-second inch in diameter (for a one-sixteenth inch diameter tool wire) and the rows 42 and 44 spaced apart about one-half inch. The rod 40 may be a three thirty-second inch wooden dowel so that it fits snugly in a perforation the friction between the periphery of the perforation and the rod being sufficient to retain the plate 16 and the rod 40 operatively fixed when the kit 10 is installed through the panel hole 12. The flexibility and resiliency of a polyethlene plate as above described provides for flexing of the plate to facilitate passage through the hole 12, but similar thickness hard board (preferably not tempered) may also be used, as may any sheet material having similar properties. The two sided adhesive tape is preferably not more than one-half inch wide, so that the plate may be cut just slightly larger than the size of the hole to be repaired. If the size of the perforations are too large in commercially available sheet material, grommets may be used to reduce the diameter of the perforations.

In repairing a hole or for strengthing the panel to support an anchor, the hole to be repaired, or a hole to receive anchor reinforcement, is generally squared, as illustrated in FIGS. 2 and 3. When using half-inch wide tape 26, the plate is cut so that its sides are one inch larger than the corresponding length of the side of the hole 12. Tape 26 is then secured to the face of the plate along its entire periphery. The feet 36 of the tool 30 are then inserted through perforations which are spaced apart sufficiently so that the legs 32 of the tool must be spread apart, thus holding the tool 30 in place. The feet 36 are inserted through the perforations 18 from the same side of the plate to which the tape 26 is secured, and until the free ends of the legs 32 are received in the perforations and the tool 30 is generally perpendicular to the face of the plate. The rod 40 is now inserted through a perforation preferably in the same horizontal row 42 as the legs 32, and mid-way between perforations receiving the legs. Shoes 60 are preferably telescoped onto the ends of the rod 40 so that the inner end of the rod has a better seat against a substantially fixed part such as an opposite panel 62, and to easy pushing the rod inwardly. The outer end portion of the rod 40 is received in the recessed portion 34 of the tool.

The outer end of the tool 30 and the rod 40 are now grasped in the fingers of one hand and the plate 16 is tilted as shown in FIG. 2, and is passed through the hole 12 generally along a diagonal of the hole. A flexible plate may bend to facilitate insertion of the plate. Next, the plate is aligned with the hole and the tool 30 is pulled outwardly to seat the adhesive tape against the inner face 24 of the panel 14, thus securing the plate to the panel. The shoe 60 on the outer end of the rod 40 is now pressed to move the rod inwardly until the shoe 60 on its inner end seats against the panel 62 or other fixed member of the hollow construction 15. Tight frictional engagement between the rod 40 and the plate 16 along the periphery of the perforation 18 operatively fixes the rod and the plate to each other so that the force of the inner shoe 60 of the rod 40 against the panel 60 (FIG. 3) further serves to anchor the plate 16 as the patching material 20 is applied in the hole 12. Prior to applying the patching material, the outer portion of the rod 40 is broken off (FIG. 4) as by gripping the rod at the plate with a pliers and snapping the end off, or cutting it off.

FIG. 6 illustrates another embodiment of a rod 70, in lieu of the rod 40, previously described. In this embodiment the rod 70 is provided with abutments 72 small enough to pass through the perforations 18 in the plate 16, so that the rod 70 may be pushed inwardly against the panel 62, and a rod abutment 72 engaged with a cooperating abutment defind by the inner face 22 of the panel 16 about the perforation which receives the rod 70. A rod of this type may be broken off with out the use of a plier or cutting instrument, and is preferably molded of polyethylene, but may be made of wood or other suitable material, if desired.

While this invention has been described and illustrated with reference to particular embodiments in a particular environment various changes may be apparent to one skilled in the art, and the invention is therefore not to be limited to such embodiments or environment except as set forth in the appended claims.

What is claimed is:

1. A kit for use in patching a hole in a panel of a hollow construction having a substantially fixed part spaced inwardly from and opposed to an inner face of the panel, the kit when operatively assembled comprising, means in the form of a substantially planar plate for insertion through the hole to be repaired and having a face for abutting engagement with the inner face of the panel substantially completely about the periphery of the hole, said plate having substantially equal sized perforations interlockable with a moldable patching material used in filling the hole, means in the form of a rod receivable in any one of said perforations and having a first end portion for seated engagement with the fixed part of the hollow construction, and means for positioning said plate in a desired position fixed to the panel for receiving the patching material while the hole is being filled, the positioning means comprising cooperating means for interengaging the rod with a portion of the plate containing the perforation receiving the rod and including the portion of said plate along a peripheral portion of the perforation which receives said rod and also including the adjacent periphery of said rod and operatively fixing said plate to said rod with said end portion of said rod seated against the fixed part of the hollow construction, and said positioning means further comprising adhesive retaining means positionable along said face of said plate for securing said plate to the inner face of the panel along the periphery of the hole to be patched.

2. A kit as set forth in claim 1 in which said cooperating means includes a snug longitudinal sliding engagement with sufficiently high frictional engagement between said rod and said peripheral portion of the perforation receiving said rod for operatively fixing said plate and said rod to each other.

3. A kit as set forth in claim 1 in which said cooperating means includes a longitudinal sliding engagement between said rod and said peripheral portion of the perforation receiving said rod, and a series of abutments extending longitudinally of said rod and selectively engaging said plate along said peripheral portion and operatively fixing said plate and said rod to each other.

4. A kit as set forth in claim 1 in which said adhesive retaining means is resilient and of sufficient thickness in a direction normal to said face of said plate for conforming to minor irregularities along the inner face of the panel.

5. A kit as set forth in claim 1 in which said positioning means includes a substantially rigid tool releasably interlockable with said plate for inserting said plate through the hole and into engagement with the inner face of the panel.

6. A kit as set forth in claim 5 in which said tool includes means releasably interlockable with said rod for retaining said plate, rod and tool operatively associated during installation of the assembly.

7. A kit as set forth in claim 6 in which said adhesive retaining means is a two-sided adhesive tape having one side adhered to said face of said plate substantially along the entire periphery of said plate after said plate has been sized to fit the hole, and an opposite adhesive side of said tape providing means for adhering to the inner face of the panel.

8. A kit as set forth in claim 7 including a tool having an operatively rigid body and at an end thereof having spaced apart feet transverse to said body and releasably extending through spaced apart ones of said perforations for releasably interlocking said tool and said plate, and an opposite end of said body having a recessed portion releasably interlockable with said rod and retaining said plate, said rod, and said tool operatively associated during installation of the assembly.

9. A kit as set forth in claim 8 in which said plate has equally spaced horizontal and vertical rows of said perforations, said operatively rigid body of said tool includes resilient legs extending from said recessed portion to free ends extending through spaced apart ones of said perforations, said feet extending from said free ends in the same direction normal to said legs, and said rod extending through a perforation substantially equally spaced from and in the same row as the last said perforations.

10. A kit as set forth in claim 9 in which said cooperating means includes a snug longitudinal sliding engagement with sufficiently high frictional engagement between said rod and said peripheral portion of the perforation receiving said rod for operatively fixing said plate and said rod to each other.

11. A kit as set forth in claim 9 in which said cooperating means includes longitudinal sliding engagement between said rod and said peripheral portion of the perforation receiving said rod, and a series of abutments extending longitudinally of said rod and selectively engaging said plate along said peripheral portion and operatively fixing said plate and said rod to each other.

12. A tool for use in patching a hole in a panel of a hollow construction comprising, opposed resilient legs connected at adjacent ends by a recessed handle portion, the handle portion acting as a guide for a tool use to insert a patch into the hole, and at opposite adjacent ends said legs having feet transverse to said legs, said feet being insertable into openings formed in the patch being inserted.

13. A tool as set forth in claim 12 in which said feet are substantially parallel to each other and extend in substantially the same general direction from and are generally normal to their legs.

14. A tool as set forth in claim 13 in which said recessed portion is between said legs and defines substantially equal included angles with each of said legs and is transverse to said legs.

15. A kit as set forth in claim 1, including a first shoe associatable with said first end portion of the rod, said first shoe increasing the area of engagement with the fixed part of the hollow construction.

16. A kit as set forth in claim 15, including a second shoe associatable with the end of said rod opposite said first end, said second shoe forming a bearing surface engageable by a user of the kit.

17. A method of patching a polygonal-shaped hole in a panel of hollow construction using a kit comprising a plate insertable into the hole to be patched and having a face for abutting engagement with the inner face of the panel substantially completely about the periphery of the hole, the plate having a plurality of substantially equally sized perforations interlockable with a moldable patching material used in filling the hole; a rod receivable in any one of the perforations and having proximal and distal end portions, and side portions engageable with portions of the plate containing the perforation receiving the rod to fix the rod and plate to each other; and adhesive retaining means positionable between the plate and the inner face of the panel for retaining the plate on the panel; said method comprising:

measuring the size of the hole to be patched;

obtaining a plate larger than the size of the hole to be patched and having at least one dimension less than the longest diagonal interconnecting corners of the hole to be patched;

inserting the rod through one of the perforations in the plate;

tilting the plate with respect to the plane of the panel to be patched and passing the plate through the hole;

pulling on the plate so that the plate moves towards the inner face of the panel into a position in which the adhesive retaining means retains the plate on the panel;

pushing on the proximal end of the rod so that the rod moves with respect to the plate into a position in which the distal end of the rod engages a fixed part of the hollow construction and a side portion of the rod is engaged with portions of the plate containing the perforation receiving the rod; and applying a moldable patching material to the plate thereby filling the hole.

18. A method according to claim 17, wherein the kit includes a tool having a body and spaced apart feet transverse to the body, the feet being insertable into perforations equally spaced from the perforation receiving the rod, the plate being pulled by pulling on the body of the tool after the feet have been inserted into the spaced perforations.

19. A method according to claim 18, including breaking off the proximal end of the rod and removing the tool from the plate before applying patching material.

* * * * *